US005490923A

United States Patent [19]

Penney

[11] Patent Number: 5,490,923

[45] Date of Patent: Feb. 13, 1996

[54] SKIMMER

[76] Inventor: Bruce B. Penney, 9 Milburn Street, Rynfeld, Benoni, Transvaal, South Africa

[21] Appl. No.: 308,333

[22] Filed: Sep. 19, 1994

[30] Foreign Application Priority Data

Apr. 21, 1994 [ZA] South Africa ..... 94/2751

[51] Int. Cl.[6] ..... E04H 3/16

[52] U.S. Cl. ..... 210/169; 210/242.1; 210/299

[58] Field of Search ..... 210/169, 242.1, 210/172, 167, 232, 299, 477, 478

[56] References Cited

U.S. PATENT DOCUMENTS

| | | | |
|---|---|---|---|
| 526,331 | 9/1894 | Tobin | 210/478 |
| 3,628,664 | 12/1971 | Stanwood | 210/169 |
| 3,774,767 | 11/1973 | Field | 210/242.1 |
| 4,068,327 | 1/1978 | Heinlein | 210/169 |
| 4,379,749 | 4/1983 | Roth | 210/169 |
| 4,455,695 | 6/1984 | Mikhel | 210/169 |
| 4,740,307 | 4/1988 | Buelteman | 210/169 |
| 4,743,368 | 5/1988 | Gates | 210/169 |
| 4,904,379 | 2/1990 | Ward | 210/242.1 |
| 5,059,314 | 10/1991 | Beckman | 210/169 |
| 5,133,854 | 7/1992 | Horvath | 210/242.1 |
| 5,336,400 | 8/1994 | Patrice | 210/169 |

FOREIGN PATENT DOCUMENTS

| | | |
|---|---|---|
| 91/4657 | 3/1992 | South Africa . |
| 93/7438 | 10/1993 | South Africa . |

*Primary Examiner*—Christopher Upton
*Attorney, Agent, or Firm*—Millen, White, Zelano, & Branigan

[57] ABSTRACT

A leaf skimmer for swimming pools or other reservoirs comprises a base to be mounted over a weir opening, a convexly curved front wall, and an opening, the skimmer capable of being mined to fact one way or the opposite way. It is provided with an inlet fitting which also may be turned to face one way or the other to direct a circulation of the water around the pool and carry leaves and other debris into the skimmer, the pool pump drawing water into the skimmer and pumping it back into the pool via the inlet fitting. The skimmer has a weir plate and non-return flap which may be inserted in the skimmer opening and adjusted to the water level, whichever way around the skimmer is mounted. A separator is provided to separate leaves which have been skimmed into a leaf trap.

6 Claims, 11 Drawing Sheets

SKIMMER

BACKGROUND OF THE INVENTION

1. Field of the Invention

The present invention relates to the cleaning of reservoirs typically swimming pools. In particular this invention relates to a skimmer adapted for use in conjunction with a weir provided in a side wall of a swimming pool.

2. Prior Art

Leaf skimmers for swimming pools exist in a sense already in most pools in the form of a weir in the side wall of the pool, water being drawn from the pool over the weir by the circulating pump. However, these weirs have only limited effect in skimming leaves and other floating debris from the water surface.

South African patent No. 91/4657 described a system intended to enhance this leaf skimming effect: the system was characterised by two features, the water returned to the pool by the circulation pump was directed with a tangential component to the pool side to induce a circulation of the water and a collecting arm or spout was directed outwardly from the weir to gather circulating debris to the weir.

It is an object of this invention to optimise this simple concept.

BRIEF DESCRIPTION OF THE INVENTION

In accordance with the present invention there is provided a reservoir skimmer which includes:

- a base having an outlet opening which base is locatable over and in front of an outlet including a weir in a side wall of a reservoir; and
- a deflection member extending from the front of the base, the deflection member forming an upright front wall at least a part of which curves convexly outwardly with an inlet opening defined between the front wall and the base, the front wall for extending into a liquid circulating in the reservoir to deflect some of the liquid and floating debris to enter,, through the inlet opening and exit through the outlet opening to subsequently proceed over the weir.

It will be appreciated that the flow direction of the liquid in the reservoir is mainly determined by the direction in which the liquid enters the reservoir through the reservoir inlet.

The present invention thus extends to an inlet device which includes:

- a fitting means fittable to a suitable reservoir inlet in a side wall of the reservoir; and
- a nozzle shaped to allow, in use, liquid to enter the reservoir generally parallel to the side wall, the fitting means adapted to allow the nozzle to be turned through 180° for opposite hand entrance of the liquid into the reservoir.

Preferably, the inlet opening of the nozzle is, in use, generally orthogonal to the side wall of the reservoir.

The fitting means, preferably, includes an "eye ball" shaped formation for allowing the nozzle to be turned through 180°.

In a preferred embodiment the nozzle has a front wall which curves convexly outwardly.

Preferably, the skimmer is shaped symmetrical about a horizontal axis such that it can be turned through 180° allowing for opposite hand debris collection with counter-circulating liquid.

Of course, the skimmer which can be turned through 180° can be used in conjunction with the inlet device of this invention. When desired, the direction of the circulating liquid can thus be changed using the inlet device and the skimmer arranged accordingly to catch the floating debris.

The present invention thus further extends to the combination of the skimmer of this invention which can be turned through 180° with the inlet device of this invention.

The present invention further provides for a kit which includes the skimmer of this invention which can be turned through 180° and the inlet device of this invention.

Preferably, the base defines an upright rear wall with the inlet opening formed between the front and rear walls.

The inlet opening is, preferably, formed at an acute angle relative to the base.

The skimmer is, preferably, provided with a roof between the top edges of the front wall and the base and a floor between the bottom edge of the front wall and the base to form a channel between the inlet and outlet openings.

In order to locate the skimmer over and in front of the outlet a suitable attachment means can be employed. Preferably, the attachment means includes a threaded rod provided with a transverse protrusion at its one end and a wing-nut at its other end. The rod, preferably, extends transversely through a suitable plastics tube. In use, the rod, preferably, extends through a hole in the front wall of the deflection member with the protrusion co-acting with the front wall and the tube at the other end of the rod located against a rear wall of the weir by tightening the wing-nut against the tube. Of course, by tightening the wing-nut the skimmer is drawn against the side wall of the swimming pool and thus located over and in front of the outlet. It is preferred that the hole is formed in a recess in the front wall. The recess is shaped such that the protrusion can co-act with a front surface thereof.

The skimmer may include a plurality of rearwardly extending locating ridges adjacent the outlet opening for locating the skimmer relative to the outlet and thus also to the weir.

The base is, preferably, rectangular with rearwardly curved edges which edges are locatable against the side wall of the reservoir. These edges are, preferably, rounded to minimise risk of injury to the user or other persons.

Preferably, suitable sealing means, for example sponge rubber or double sided tape, is provided at the edges for, in use, sealing against the side wall of the reservoir.

It is preferred that the rear of the base is provided with a plurality of strengthening ribs.

The skimmer is, preferably, adapted for use in conjunction with a hose attached to a reservoir cleaning apparatus. To this end the skimmer may be provided with an access opening in the base adjacent and outwardly of the rear of the deflection member the access opening adapted to allow the hose to pass through it and proceed over the weir.

The access opening may be circular and just large enough to allow for movement of the hose. Alternatively, the access opening may be in the form of an upright slot adapted to allow up and down movement in the slot of that part of the hose located in the slot. A cover plate pivotally attached to the base may be provided in order to close the access opening when the skimmer is used without the hose. The shape of the cover plate may be similar to that of the access opening, for example circular when the access opening is circular.

The skimmer is also, preferably, adapted to be provided with a weir plate for generally closing off a part of the inlet opening extending upwards from the floor and between the front and rear walls. The weir plate provides a top edge to be positioned just below the liquid surface. When the top edge is positioned just below the liquid surface and with the reservoir pump running an increased liquid flow velocity over the top edge will occur compared to the slower liquid flow velocity when the skimmer is employed without the weir plate. Due to the increased liquid flow velocity the floating debris will be sucked into the skimmer much faster and from a wider surface area adjacent the skimmer inlet opening.

It is preferred that the weir plate can be moved upwards and downwards to re-position the top weir plate edge as desired. In order to accomplish this, the front edges of the front and rear walls of the skimmer are each, preferably, provided with grooves to accommodate the respective side edges of the weir plate.

In order to minimise the backflow of floating debris which has already entered the skimmer, but not yet been forwarded into the filtering system of the reservoir the weir plate is, preferably, provided with a non-return weir flag, hingedly attached to the weir plate. It is preferred that the weir flap is hingedly attached to the top edge of the weir plate. Without a weir plate backflow of said debris may occur after the reservoir pump has been switched off.

By "non-return" it is meant that during normal functioning of the weir flap it can not be hinged through the inlet opening towards the liquid in the reservoir. The weir flap will thus keep the major part of the debris, if not all, from re-entering the reservoir.

During use, the vibration of the hose will deflect debris out in front of the deflection member towards the deflection member. More specifically, the vibration of the hose will deflect the debris through the inlet opening of the skimmer. Of course, the vibration of the hose will be caused by the reservoir cleaning apparatus, for example one known in the trade under the trade name "Kreepy Krauly" or "Baracuda".

The skimmer, preferably, includes a retaining means for keeping a length of the hose adjacent the deflection member.

The retaining means may include an eyelet or a loop, for example formed by a tie strap, dimensioned to allow the hose to pass through it.

For the hose to effectively deflect the liquid and debris it is preferred that the deflection member is provided with an indication means for indicating a preferred high level and a preferred low level for the liquid in the reservoir. Thus, during use, as the liquid level rises and falls the hose will, of course, rise and fall accordingly.

One or more floats may be attached to the hose at strategic positions to enhance the hose's buoyancy and thus to assist the hose in deflecting debris out in front of the deflection member towards the deflection member.

A float in accordance with the present invention includes two side members of which the bottoms are connected to each other and of which the tops are spaced from each other to define an access opening leading to a hose receiving space between the two side members the shape of the two side members being such that they can be slid and clipped onto a hose to be removably attached to the hose.

Preferably, each of the side members is in the form of a bulge the one bulge having a mirror image to that of the other bulge. Preferably, the main part of the bulge is directed towards the bottom.

The bulge may have a surface which curves convexly outwardly.

In a preferred embodiment each of the two side members and the hose receiving space is elongate in the same direction, the surface bounding the hose receiving space conforming to an arc of a circle.

The present invention extends to a reservoir skimmer adapted for use in conjunction with a hose attached to a reservoir cleaning apparatus the reservoir skimmer including:

a base which is locatable over and in front of an outlet including a weir in a side wall of a reservoir; and a deflection member extending from the front of the base the deflection member, in use, extending into a liquid circulating in the reservoir to deflect some of the liquid and floating debris to subsequently proceed over the weir, an upright slot in the base adjacent and outwardly of the rear of the deflection member the slot adapted to allow the hose to pass through it and proceed over the weir and also to allow up and down movement in the slot of that part of the hose located in the slot.

It will be understood that the skimmer of the previous paragraph may have the same features as the skimmer disclosed above including a deflection member having an upright front side wall. Of course, the access opening of the skimmer of the previous paragraph must be in the form of an upright slot.

The present invention extends to a method of removing floating debris from a reservoir which method includes:

using a skimmer of this invention in conjunction with a hose at its one end attached to a reservoir cleaning apparatus and its other end extending through the skimmer and into an outlet including a weir in a side wall of the reservoir; and causing the hose to vibrate under influence of the cleaning apparatus so that a length of the hose to the front of the skimmer deflects debris towards and into the skimmer.

In a preferred embodiment the method includes using an inlet device of this invention to allow liquid to enter the reservoir generally parallel to the side wall thus causing a flow of liquid and floating debris towards the skimmer.

The method may further include using one or more floats attached to the hose at strategic positions to enhance the hose's buoyancy. Preferably, the method includes using one or more floats of this invention.

The present invention also extends to a method of removing floating debris from a reservoir which method includes using an inlet device of this invention to allow liquid to enter the reservoir generally parallel to the side wall of the reservoir thus causing a flow of liquid and floating debris towards an outlet in the side wall of the reservoir.

The invention further extends to a separating device suitable for use with a skimmer of this invention and locatable in an outlet chamber adjacent a weir in a side wall of a reservoir, which separating device includes:

a resilient engagement member generally forming the border of the separating device the engagement member, in use, engaging an upright wall of the chamber; and a flexible separating material attached to the engagement member and to be stretched across the chamber when the major part of the engagement member engages the upright wall, the separating material, when stretched, allowing a liquid to pass through it, but preventing a major part of floating debris to pass through it.

It will be appreciated that the separating device may be used above a suction control valve used in conjunction with the hose previously mentioned and also above a bottom strainer in the chamber.

In a preferred embodiment the engagement member includes a generally circular spring which curves convexly outwardly and has two ends each of which includes a gripping member one or both of which members can be used to bend the spring inwardly into a general oval shape thereby relaxing the separating material and thereby allowing the separating device to be placed within the chamber the major part of the spring engaging the upright wall of the chamber when the gripping member(s) is/are released.

Preferably, the separating material includes two pieces of material each piece having a curved outer edge attached to the spring and a free inner edge, each piece of material, in use, generally covering its own half of an area across the chamber with the two inner edges then overlapping.

BRIEF DESCRIPTION OF THE DRAWINGS

The invention will now be described, by way of example only, with reference to the accompanying drawings in which.

DESCRIPTION OF THE PREFERRED EMBODIMENT

Figure 1:
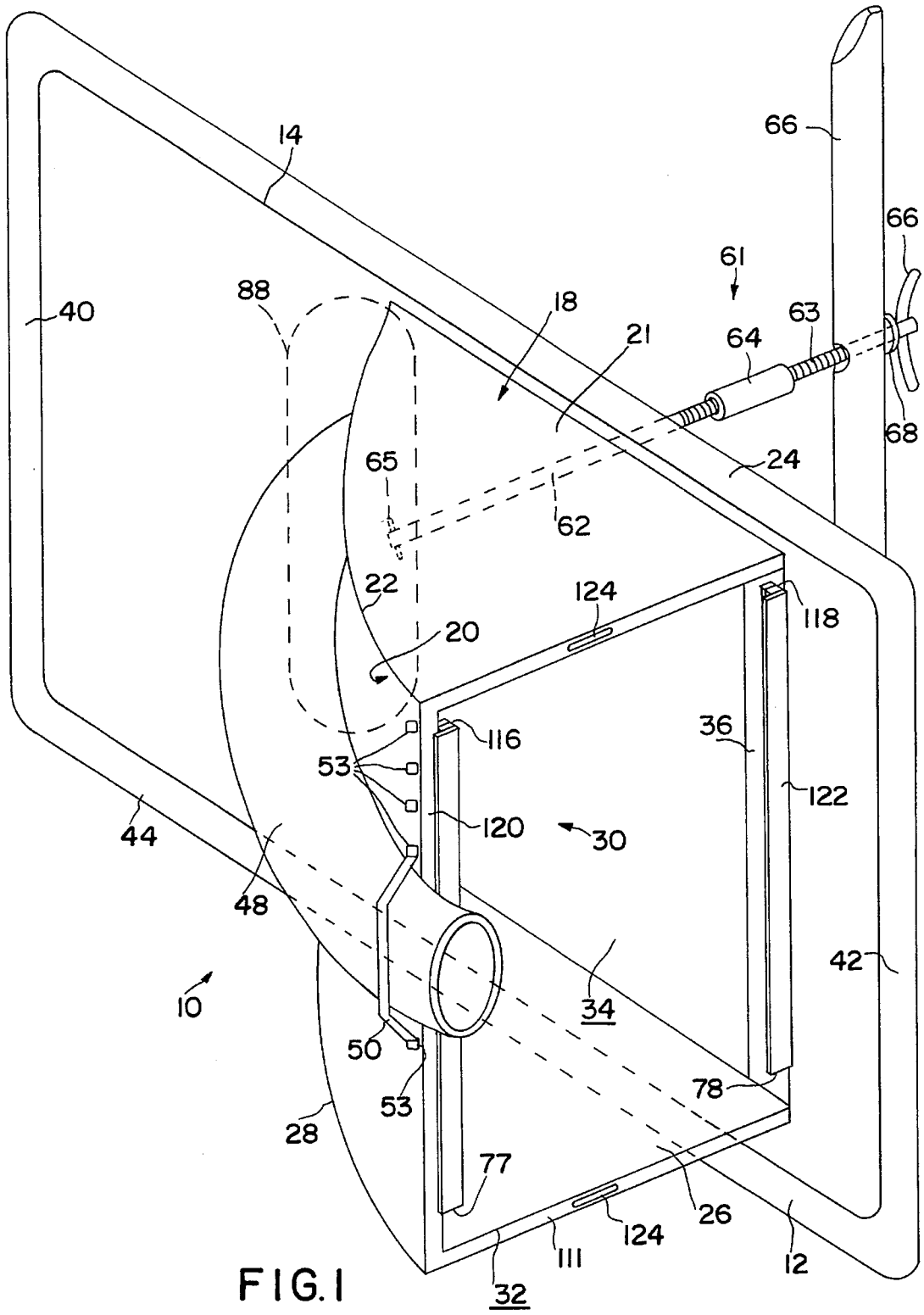
FIG. 1 is a pictorial view of a reservoir skimmer in accordance with a preferred embodiment of the present invention a length of a hose and an attachment means also shown.

A reservoir skimmer 10 in accordance with a preferred embodiment of this invention includes a rectangular base 12 having a front 14 and a rear 16 and further a deflection member 18 extending from the front 14 of the base 12.

Figure 3:
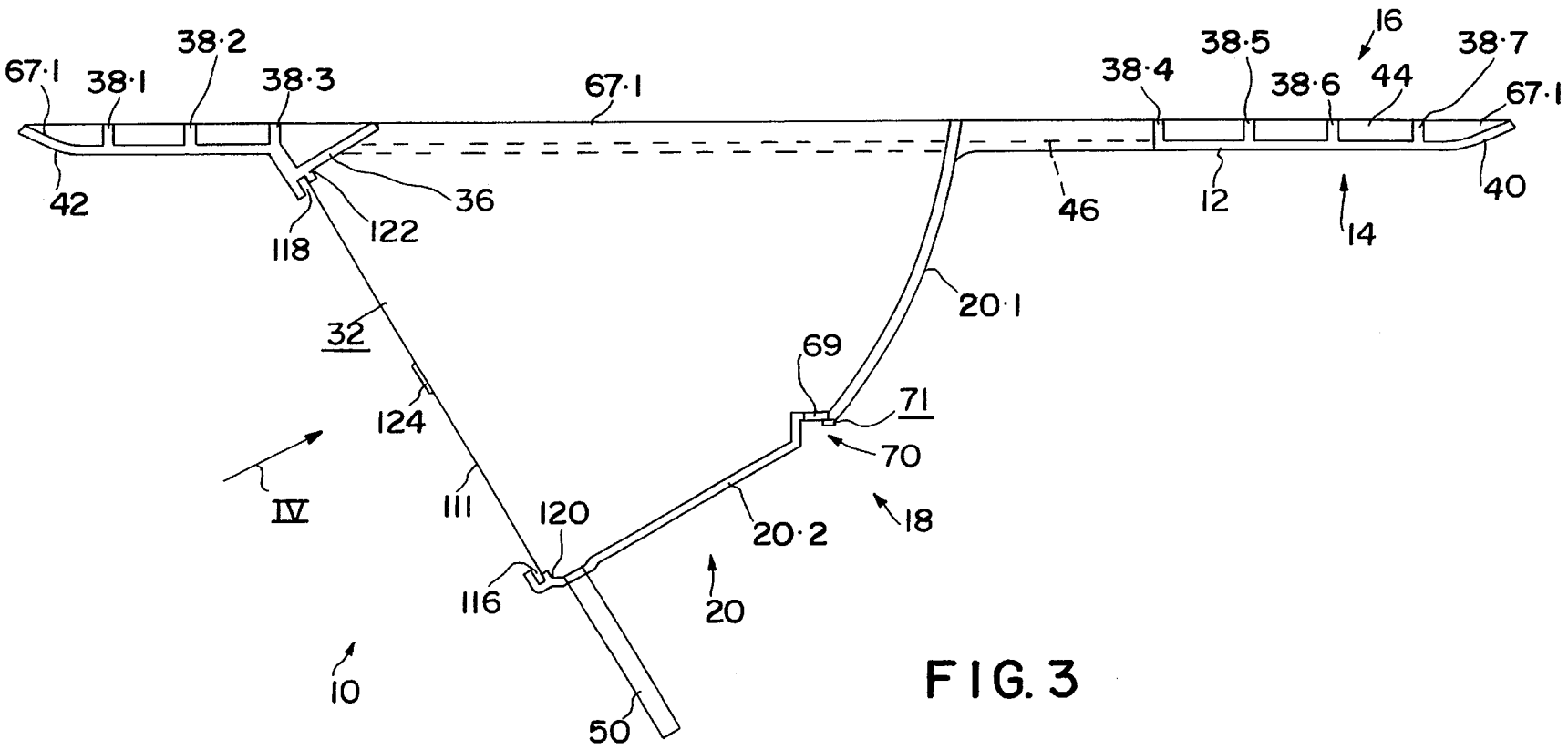
FIG. 3 is a cross sectional view on line III—III of the skimmer shown in FIG. 2.
Figure 4:
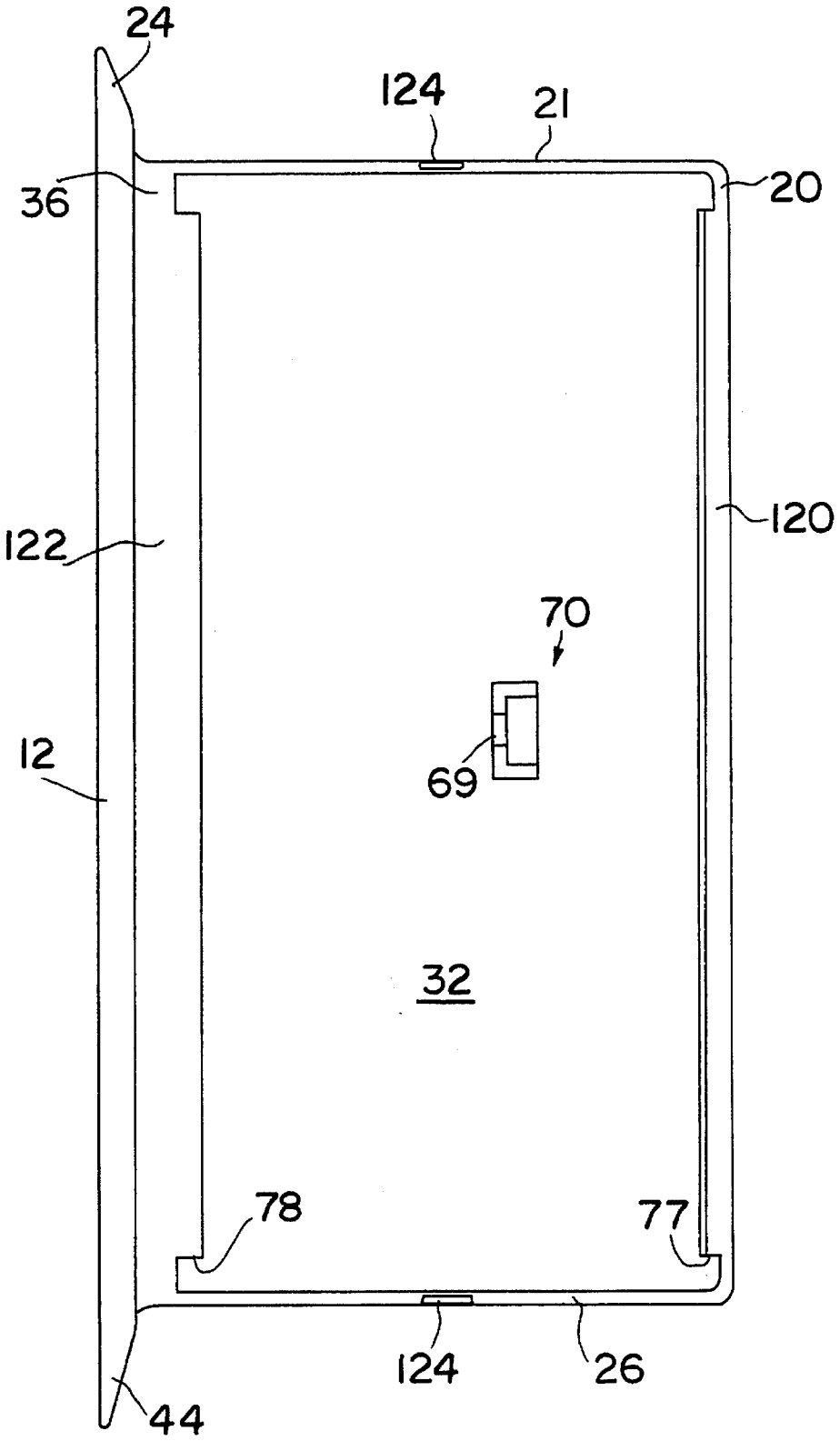
FIG. 4 is a view towards the inlet opening of the skimmer shown in FIG. 3 in the direction of the arrow IV.

The deflection member 18 forms an upright front wall 20 including two parts, namely, a first part 20.1 which curves convexly outwardly and a second straight part 20.2 as shown in FIG. 3.

The skimmer 10 has a roof 21 extending between the top edges 22, 24 of the front wall 20 and the base 12. A floor 26, parallel to the roof 21, is provided between the bottom edge 28 of the front wall 20 and the base 12. A channel 30 is thus formed interconnecting an inlet opening 32 defined between the front wall 20 and an outlet opening 34 in the base 12. FIG. 3 shows that the inlet opening 32 is formed at an acute angle relative to the base 12.

The base 12 defines a straight upright rear wall 36 as shown in FIGS. 1 and 3. The inlet opening 32 is defined between the rear wall 36 and the front wall 20.

Two pairs of locating ridges each pair including a horizontal locating ridge 37.1 which is a rearward extension of the base 12 and an upright locating ridge 37.2 are provided.

Figure 2:
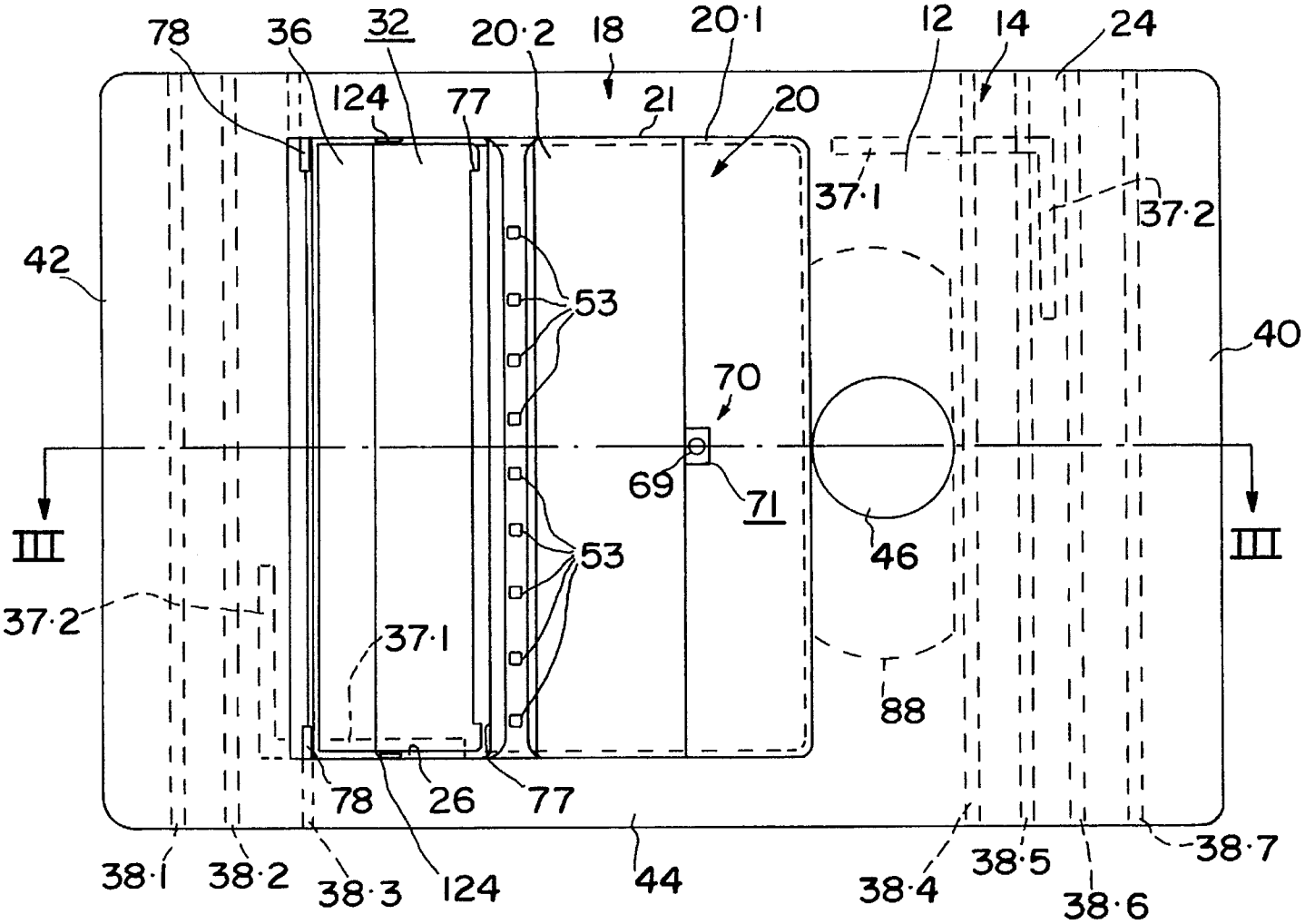
FIG. 2 is a front view of the skimmer shown in FIG. 1, but turned through 180°.

FIGS. 2 and 3 show that the rear 16 of the base 12 is provided with a plurality of strengthening ribs 38.1, 38.2, 38.3, 38.4, 38.5, 38.6, 38.7 spaced apart and parallel to each other. The top, side and bottom edges 24, 40, 42, 44 of the skimmer 10 curve rearwardly.

FIGS. 2 and 3 further show that the base 12 has an access opening in the form of a circular hole 46 adjacent and outwardly of the rear of the front wall 20. A hose 48, shown in FIG. 1, attached to a swimming pool cleaning apparatus passes through the hole 46.

Figure 8:
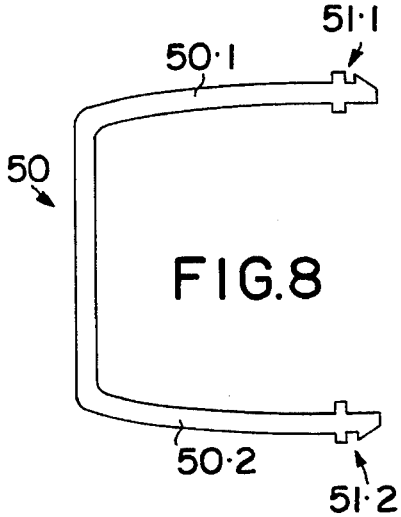
FIG. 8 is a side view of a tie strap shown in FIG. 1 to keep the hose close to the skimmer.

Retaining means in the form of a plastics tie strap 50 clipped into to the front wall 20 is used to keep a length of the hose 48 adjacent the deflection member 18. FIG. 8 shows that the tie strap 50 includes two legs 50.1, 50.2 interconnected by an interconnecting member 50.3. Each end of the legs 50.1, 50.2 is provided with a clipping means 51.1, 51.2 which clips into appropriate holes 53 in the straight part 20.2 of the front wall 20. Of course, these holes 53 thus allow for variable height of water level.

Figure 15:
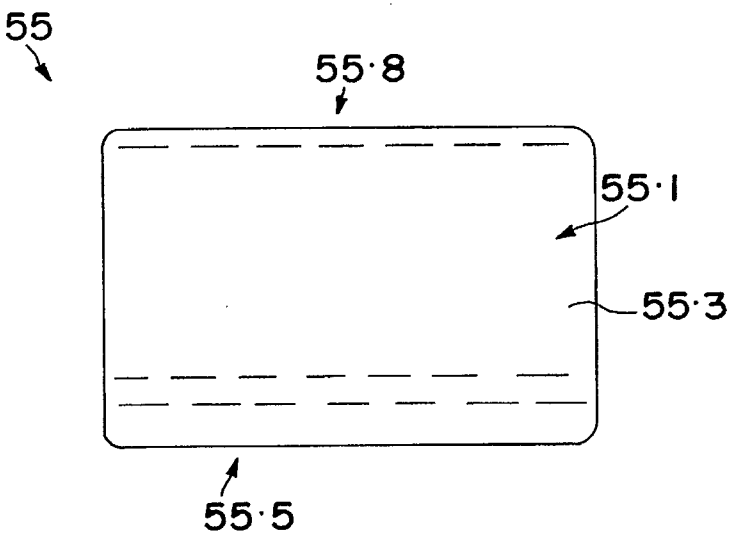
FIG. 15 is a side view of the float shown in FIG. 14.
Figure 14:
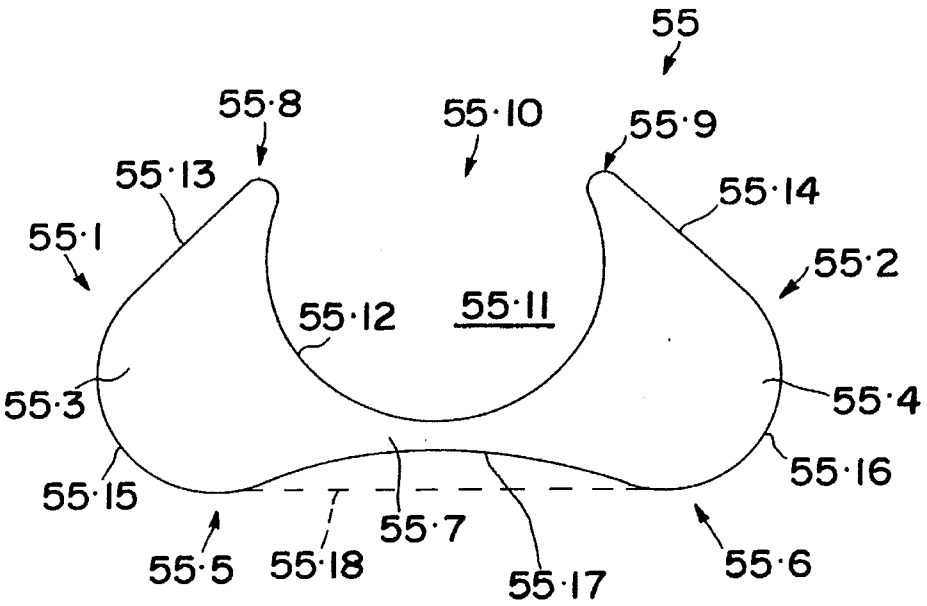
FIG. 14 is a front view of a float in accordance with a preferred embodiment of the present invention.

A float may be attached to the hose 48 at a position 56 in front of the deflection member 18. FIGS. 14 and 15 show one such float 55 which includes two elongate side members 55.1, 55.2 mainly shaped to form a bulge 55.3, 55.4 one bulge having a mirror image to that of the other bulge. The main part of each bulge 55.3, 55.4 is directed towards the bottom 55.5, 55.6. FIG. 14 shows that the bottoms 55.5, 55.6 are connected to each other by an interconnecting piece of material 55.7. The two tops 55.8, 55.9 are spaced from each other to define an access opening 55.10 leading to a hose receiving space 55.11. The surface 55.12 bounding the space 55.11 conforms to an arc of a circle. FIG. 14 further shows that each bulge 55.3, 55.4 has an inclined, flat upper surface 55.13, 55.14 each leading downwards into a surface 55.15, 55.16 curving convexly outwardly. The interconnecting member 55.7 defines a bottom surface 55.17 curving convexly inwardly. In an alternative embodiment the interconnecting member 55.17 defines a bottom surface 55.18 which is flat.

In use, the float 55 is slid and removably clipped onto the hose 48 in such a manner that the hose 48 can press downwards onto the interconnecting member 55.17 thereby keeping at least part of the convex surfaces 55.15, 55.16 in the water.

The skimmer 10 further includes a weir plate and weir flap combination of which two embodiments 100.1 and 100.2 are shown.

The combination 100.1 includes a rectangular plastics weir plate 102 and a floatable plastics non-return wedge shaped weir flap 104 hingedly attached to a top edge 106 of the weir plate 102 to be movable about a horizontal axis 108.

A plurality of serrations 110 (only a few shown) are provided on the weir plate 102 to co-act with the front edge 111 of the floor 136. The parallel side edges 112, 114 respectively fits into upright grooves 116, 118 provided at the front edges 120, 122 of the front and rear walls 20, 36 of the skimmer 10. The weir plate and weir flap combination 100.1 can be moved upwards and downwards as desired by using a handgrip 111.1 extending from the weir plate 102. The serrations 110 are adapted to co-act with a protrusion 124 at the floor 26. Indication means which includes a high level water mark 52 and a low level water mark 54 are provided at the sides of the weir flap 104, for example in the form of protrusions. Of course, the low level water mark 54 may have several individual markings on it. The low level water mark 54, preferably, indicates an ideal water level.

The alternative weir plate and weir flap combination 100.2 includes a rectangular plastics weir plate 126 and a rectangular plastics weir flap 128 hingedly attached to a top edge 130 of the weir plate 126 to be movable about a horizontal axis 132. More specifically, a tube 127 at the bottom edge 129 of the weir flap 128 fits around a major part of the top edge 130 which is in the form of an elongate strip 131 with a through slit 133 between the strip 133 and the major part 135 of the weir plate 126. In order to render the weir flap 128 buoyant it is provided with a rectangular float made of a piece of polystyrene 134. The parallel side edges 136, 138 respectively fits into the upright grooves 116, 118 provided at the front edges 120, 122 of the front and rear walls 20, 36 of the skimmer 10. The weir plate and weir flap combination 100.2 can thus be moved upwards and downwards as desired by using a handgrip 139. A small protrusion 140 is provided at the bottom edge 142 of the weir plate 126 to co-act with the front edge 111, in particular the protrusion 124 of the floor 26. Serrations 125 similar to the serrations 110 are provided. The weir flap 128 is, preferably, provided with similar high and low level marks to that of the weir flap 104.

In order to use the skimmer 10 it must be located and attached over an outlet of a reservoir typically a swimming pool. A typical outlet 58 and a weir 59 in a swimming pool side wall 60 is shown in FIG. 13.

Figure 13:
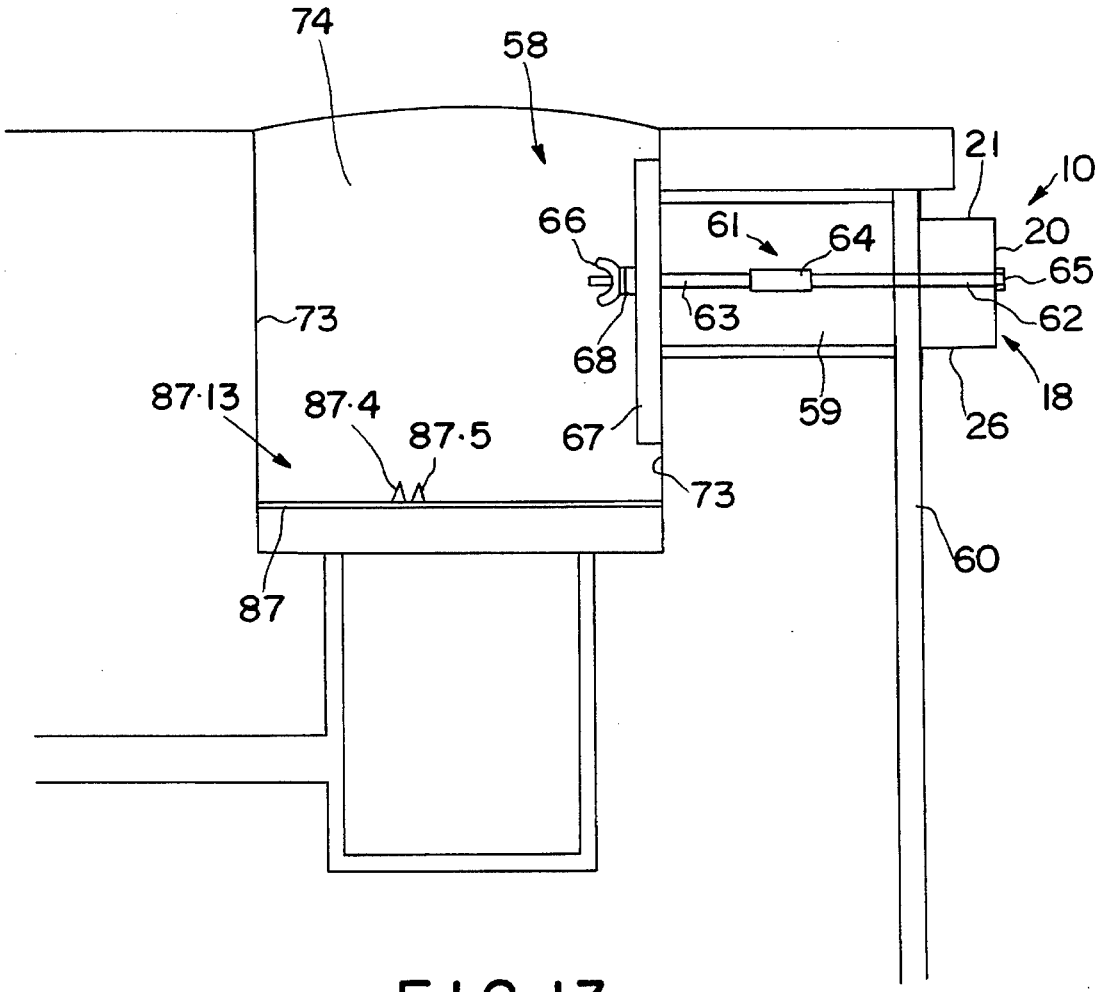
FIG. 13 is a cross-sectional view on line 13—13 through the skimmer, weir and chamber shown in FIG. 5.

Attachment means 61 is used as shown in FIGS. 1 and 13. The attachment means 61 includes two suitably threaded rods 62, 63 interconnected by an internally threaded tube 64. Of course, the total length of the attachment means can be varied by turning the rods 62, 63 outwardly from the tube 64. The attachment means 61 further includes a transverse protrusion 65 at its one end and a wing-nut 66 at its other end. A fairly stiff plastics tube 67 is provided adjacent the wing-nut 66 with the rod 63 extending transversely through the tube 67. A washer or nut 68 may be located between the wing-nut 66 and the tube 67.

The surfaces of the edges 24, 40, 42, 44 facing the swimming pool side wall 60 are each provided with suitable sealing means, for example sponge rubber 67.1. Double-sided tape to adhere to the side wall 60 instead of the sponge rubber 67.1, may be used. Using the sponge rubber or the tape generally ensure sealing at the edges 24, 40, 42, 44 thus confining the flow of the liquid through the inlet opening 32. When desired, the appropriate pair of locating ridges 37.1, 37.2 may be fitted into a top fight hand comer of the weir 59 at the front of the outlet at the side wall 60 of the pool 76 to suitably locate the skimmer 10 relative to the weir 59. The rod 62 can then be inserted through a hole 69 in a recess 70 in the front wall 20 of the skimmer 10 until the protrusion 65 seats onto the front surface 71 of the recess 70. The interconnecting tube 64 and other rod 63 are then added onto the rod 62. Subsequently the rod 63 is located through the plastics tube 67 and the plastics tube 67 located vertically across the outlet 72 of the weir 59 against the wall 73 of the chamber 74. The wing-nut 66 is then used to tighten the skimmer 10 over the outlet 58. The curved top, side and bottom edges 22, 40, 42, 44 of the base 12 will then be snugly located against the side wall 60. Subsequently, the hose 48 can be placed in position as shown in FIG. 1 the hose 48 thus extending through the tie strap 50 and the hole 46.

Figure 10:
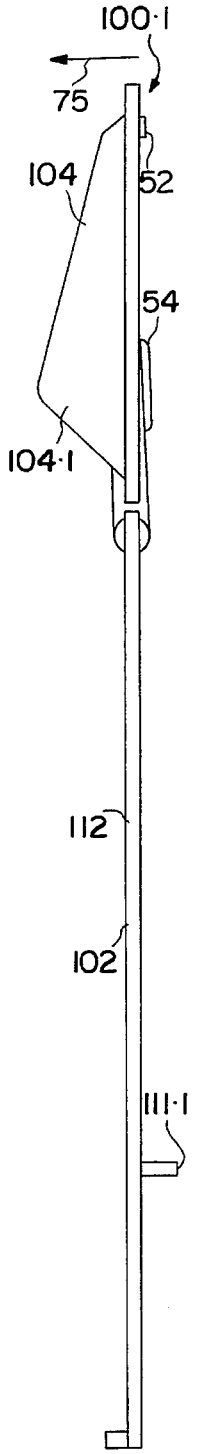
FIG. 10 is a side view of the weir plate and weir flap combination shown in FIG. 9.
Figure 11:
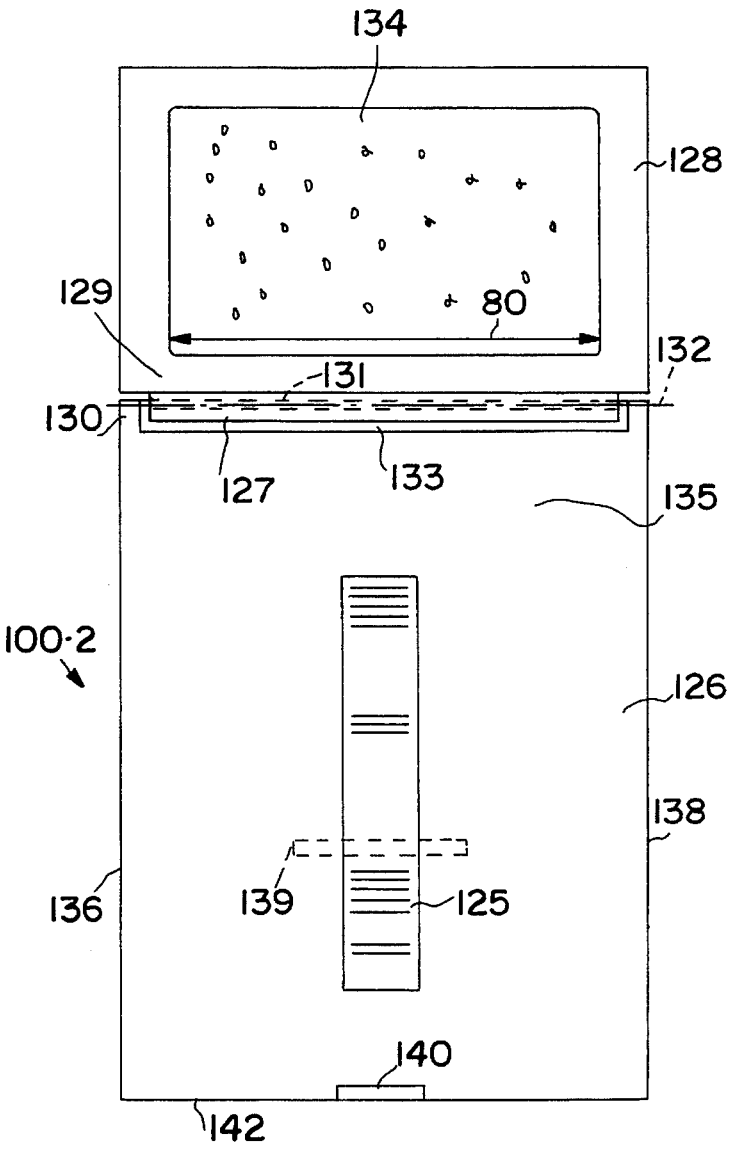
FIG. 11 is a rear view of an alternative weir plate and weir flap combination.
Figure 12:
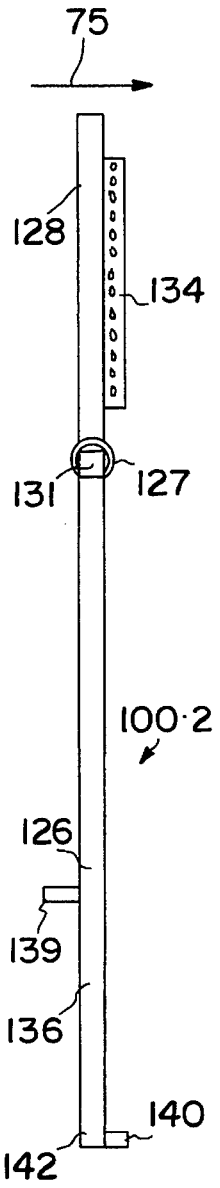
FIG. 12 is a side view of the weir plate and weir flap combination as shown in FIG. 11.

Any one of the weir plate and weir flap combinations 100.1, 100.2 may be used. The plate and weir flap combination 100.1, 100.2 is positioned by, firstly, hinging the weir flap 104, 128 forward in the direction of the arrow 75 shown in FIGS. 10 and 12 to be at approximately 90° relative to the weir plate 102. 126. The weir flap 104, 128 is then inserted through the inlet opening 32 of the skimmer 10, more specifically beneath the bottom ends 77, 78 of the grooves 116, 118 just above the floor 26. The widths 79, 80 of the wedge shaped part 104.1 and the polystyrene 134 are such that these parts will not interfere with the insertion. Subsequently, the weir plate 102, 126 is moved upwards with the edge 114, 138 sliding in the groove 116 and the edge 112, 136 sliding in the groove 118. The weir plate 102, 126 is moved upwards until the weir plate top edge 106, 130 is located just beneath the water surface. Care must be taken in this regard, that is, to ensure that at all times when the pool pump is running that water flows over the top edge 106, 130. Should no water enter the skimmer 10 due to the top edge 106, 130 located above the water surface pump overheating or even burn-out may result.

Figure 5:
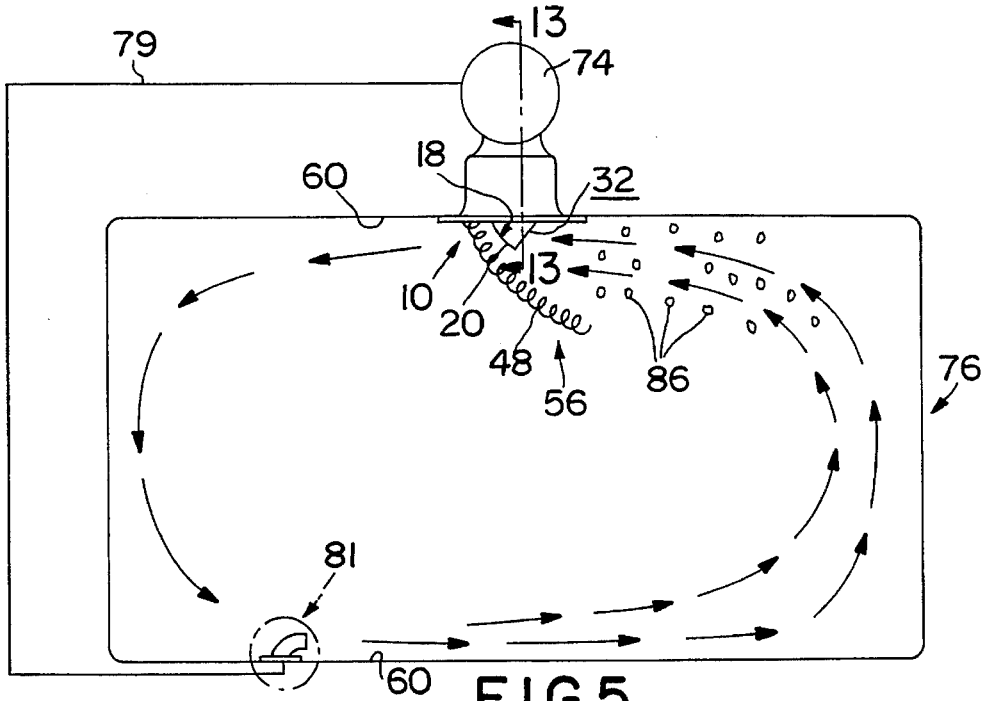
FIG. 5 is a plan view of a swimming pool including the skimmer as shown in FIG. 1.
Figure 6:
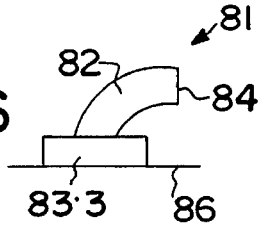
FIG. 6 is an enlarged view of a nozzle of an inlet shown in FIG. 5.
Figure 7:
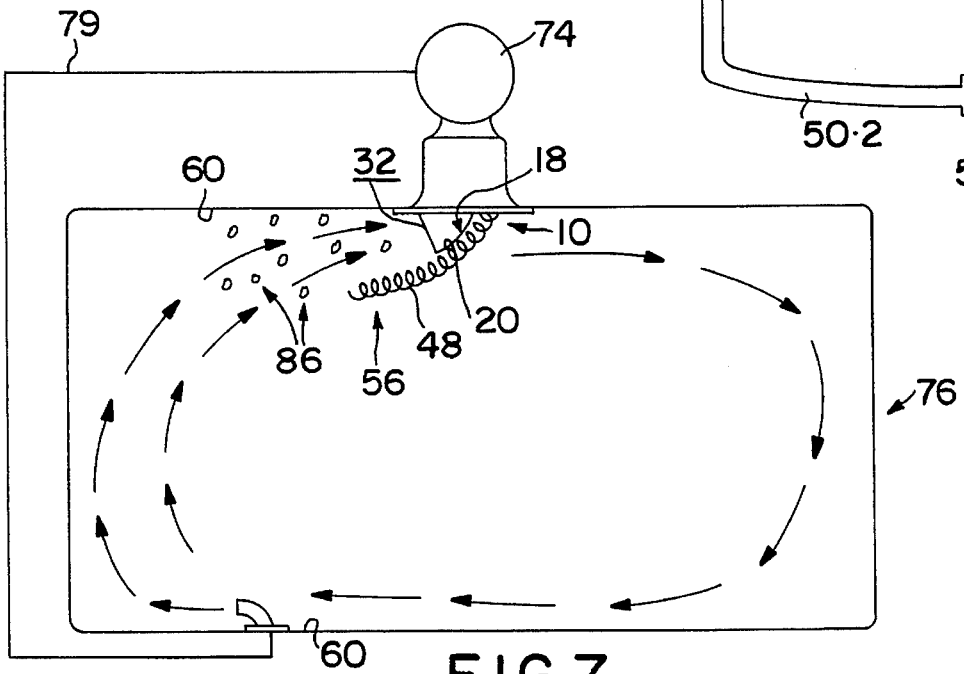
FIG. 7 is a plan view of the swimming pool shown in FIG. 5, but with the skimmer and nozzle turned through 180°.
Figure 9:
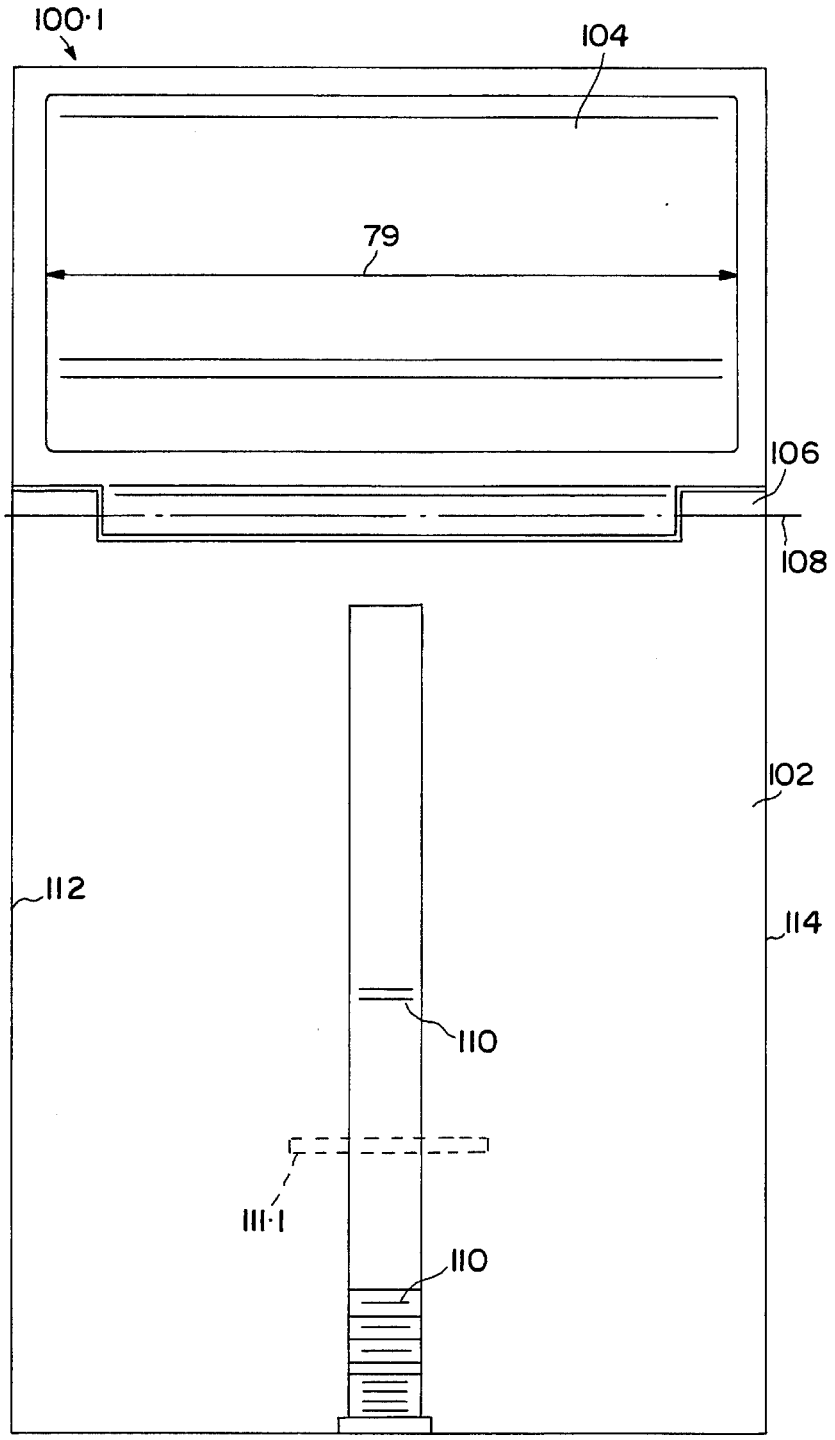
FIG. 9 is a rear view of a weir plate and weir flap combination for use with the skimmer as shown in FIGS. 1, 2 and 3.
Figure 16:
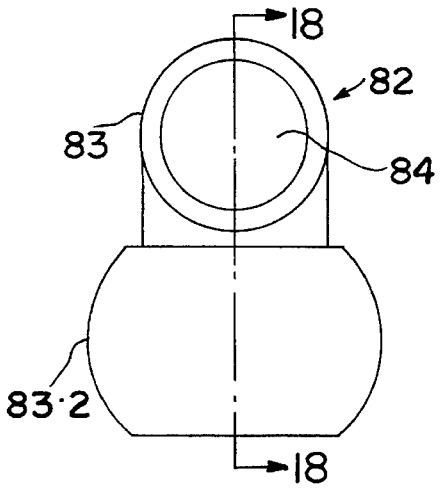
FIG. 16 is a front view of an inlet device in accordance with a preferred embodiment of the present invention.
Figure 17:
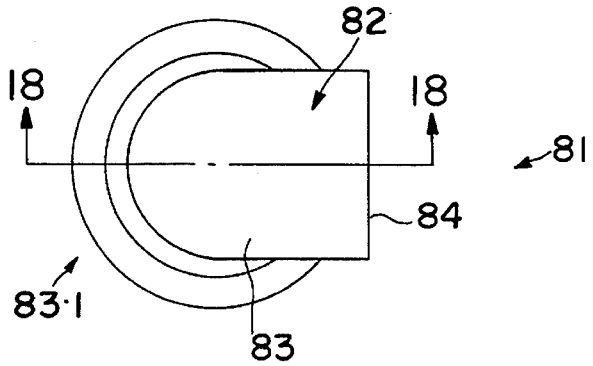
FIG. 17 is a plan view of the inlet device shown in FIG. 16.
Figure 18:
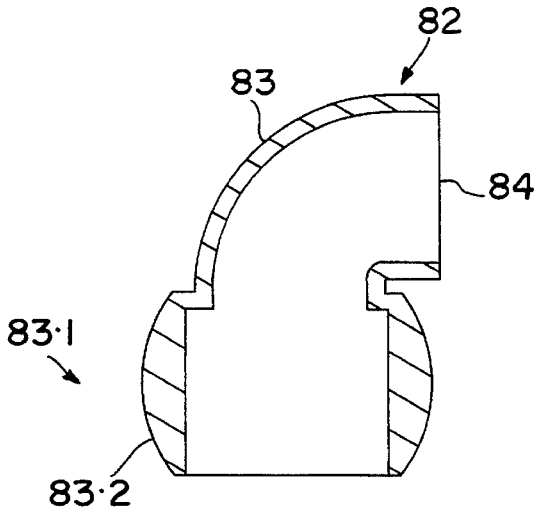
FIG. 18 is a cross-sectional view on line 18—18 through the inlet device shown in FIGS. 16 and 17.

When the water in a swimming pool 76 is circulated under influence of its circulation system 79 the direction of flow of the water is as indicated by the anti-clockwise arrows in FIG. 5. Of course, the direction of flow is largely determined by the shape of the inlet device 81. FIG. 6 shows that the inlet device 81 includes an arcuate nozzle 82 having an inlet opening 84 orthogonal to the side wall 60 of the swimming pool 76. Of course, when the nozzle 82 has been turned through 180°, as shown in FIG. 7, the direction of flow of the water is as indicated by the clock-wise arrows. FIGS. 16, 17 and 18 show the inlet device 81 in more detail. The nozzle 82 has a front wall 83 which curves convexly outwardly. A fitting means 83.1 of the inlet device 81 includes a hollow "eye ball" shaped formation 83.2 adapted to co-act with a nut 83.3 (see FIG. 6) which keeps the inlet device 81 to the side wall 60. Of course, the nut 83.3 fits over the "eye ball" shaped formation 83.2. FIGS. 5 and 7 show that the nozzle 82 allows the water to enter the swimming pool 76 generally parallel to the side wall 86.

In use, thus, the deflection member 18, specifically the front wall 20, deflects a flow of water and, of course, debris 86 in that flow so that the water and debris 86 enter the inlet opening 32 of the skimmer 10. The water and debris 86 then proceed along the channel 30 and exit the skimmer 10 through the outlet opening 34 in the base 12 and proceed over the weir 59 into a debris trap (not shown) in the chamber 74. The cleared water is subsequently pumped through the circulation system 78 towards and through the inlet nozzle 82 into the swimming pool 76.

Figure 19:
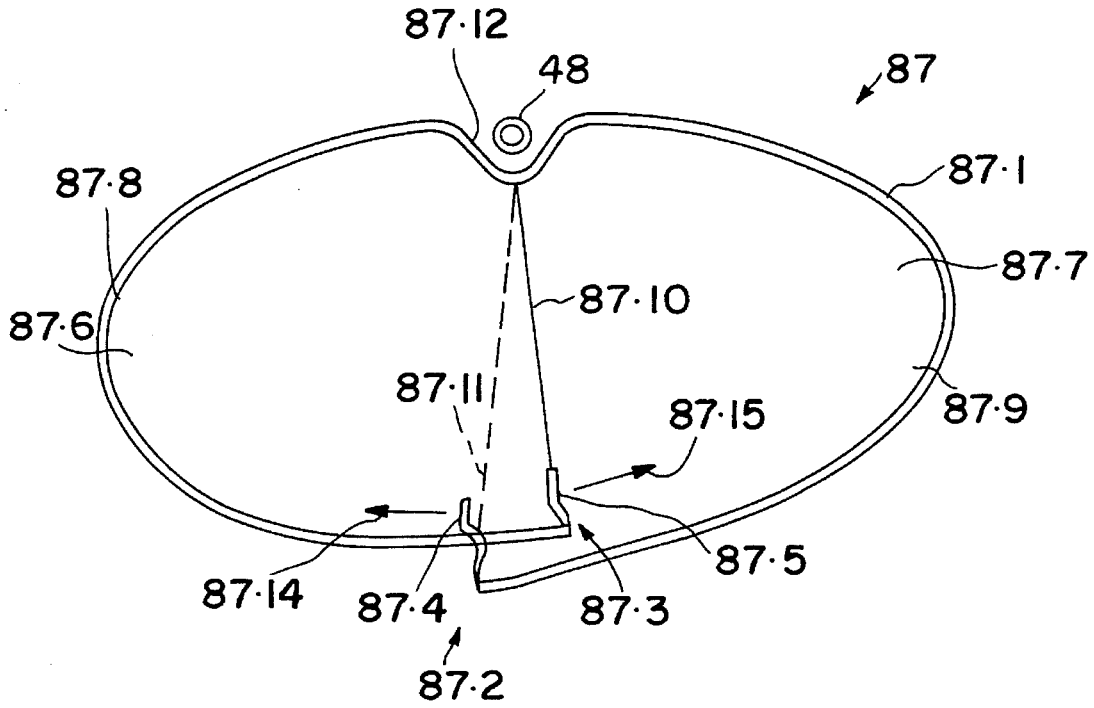
FIG. 19 is a plan view of a separating device in accordance with a preferred embodiment of the present invention.

FIG. 19 shows a separating device or debris trap 87 which includes a resilient member in the form of a spring 87.1 which curves convexly outwardly. The spring 87.1 has two ends 87.2, 87.3 each including an upwardly extending gripping member 87.4, 87.5. The debris trap 87 further includes two pieces of flexible separating material 87.6, 87.7 each in the form of a net capable of trapping the floating debris. Each net 87.6, 87.7 has a curved outer edge 87.8, 87.9 and a free inner edge 87.10, 87.11. Each of the curved outer edges 87.8, 87.9 is attached to the spring 87.1. The free inner edges 87.10, 87.11 respectively extends between the gripping member 87.4, 87.5 and a recess 87.12 in the spring 87.1.

In order to use the debris trap 87 it must be located in the chamber 74, for example at the position 87.13 above a suction control valve (not shown) used in,, conjunction with the hose 48 and also above a bottom strainer (not shown). Firstly, the gripping members 87.4, 87.5 are moved away from each other in the directions shown by the arrows 87.14, 87.15 thereby bending the spring 87.1 inwardly and relaxing the nets 87.6, 87.7. The debris trap 87 is then arranged at the position 87.13 and the gripping members 87.4, 87.5 released causing the spring 87.1 to engage the upright wall 73 around the chamber 74. The nets 87.4, 87.5 are then in a stretched condition across the chamber 74 with the free inner edges 87.10, 87.11 overlapping each other. The recess 87.12 allows the hose 48 to by-pass the debris trap. When a sufficient amount of debris has been trapped the debris trap 87 can be removed from the chamber and cleaned. Removal is done by again moving the gripping members 87.4, 87.5 away from each other as previously mentioned. FIG. 19 shows the spring 87.1 in an inwardly bent generally oval condition. In use, when the spring 87.1 engages the upright wall 73 it will have a general circular shape.

The hose 48 which vibrates under influence of the swimming pool cleaning apparatus acts as an auxiliary deflection member to deflect the debris 86 out in front of the deflection member 18 of the skimmer 10 towards and into the inlet opening 32.

When the access opening is in the form of an upright slot 88 that part of the hose 48 extending through the upright slot 88 is allowed to move up and down as the level of the water in the swimming pool 76 rises and falls.

The skimmer 10 is manufactured from a suitable plastics material using a suitable moulding process.

It will be understood that when the skimmer 10 as shown in FIGS. 1 and 5 is turned through 180° the roof 21 becomes the floor 26 and vice versa. Of course, the top edge 24 becomes the bottom edge 44 and vice versa. However, in FIGS. 2, 3, 4, 7 and 13 the same reference numerals have been used to indicate those parts which have been turned through 180°.

I claim:

1. A reservoir skimmer which includes:

a base having an outlet opening which base is generally flat and sufficiently large to entirely cover an outlet including a weir in a side wall of a reservoir, and a deflection member extending from the front of the base, the deflection member forming an upright front wall at least a part of which curves convexly outwardly with an inlet opening defined between the front wall and the base, the front wall for extending into a liquid circulating in the reservoir to deflect some of the liquid and floating debris to enter through the inlet opening and exit through the outlet opening to subsequently proceed over the weir, provided with a roof between the top edges of the front wall and the base and a floor between the bottom edge of the front wall and the base to form an enclosed channel between the inlet and outlet openings and a weir plate closing off a part of the inlet opening extending upwards from the floor and between the front wall and the base.

2. A reservoir skimmer as claimed in claim 1, in which the weir plate is provided with a non-return weir flap hingedly attached to the weir plate.

3. A reservoir skimmer as claimed in claim 1, further comprising an access opening in the form of an upright slot to allow up and down movement in the slot of a hose located in the slot and having a cover plate pivotally attached to the base in order to close the access opening when the skimmer is used without the hose.

4. A reservoir skimmer as claimed in claim 3, provided with one or more floats which may be attached to the hose at strategic positions to enhance the hose's buoyancy and thus to assist the hose in deflecting debris out in front of the deflection member towards the deflection member the floats comprising two mirror imaged bulges with interconnecting material between them defining an access opening for a hose.

5. A reservoir skimmer as claimed in claim 1, provided with an attachment means which includes a threaded rod provided with a transverse protrusion at its one end and a wing-nut at its other end, the rod extending transversely through a suitable plastics tube.

6. A reservoir skimmer as claimed in claim 1, provided with a separating device suitable for use with a skimmer of this invention and locatable above a filter basket in an outlet chamber adjacent a weir in a side wall of a reservoir, which separating device includes a resilient engagement member generally forming the border of the separating device the engagement member, in use, engaging an upright wall of the chamber, and a flexible separating material attached to the engagement member and to be stretched across the chamber when the major part of the engagement member engages the upright wall, the separating material, when stretched, allowing a liquid to pass through it, but preventing a major part of floating debris to pass through it.

* * * * *